US008796600B2

(12) United States Patent
Handa

(10) Patent No.: US 8,796,600 B2
(45) Date of Patent: Aug. 5, 2014

(54) INDUCTION WARMING SYSTEM FOR FIBER COMPOSITE GAS STORAGE CYLINDERS

(75) Inventor: Kiyoshi Handa, Takanezawa-cho (JP)

(73) Assignee: Honda Motor Co., Ltd., Tokyo (JP)

( * ) Notice: Subject to any disclaimer, the term of this patent is extended or adjusted under 35 U.S.C. 154(b) by 978 days.

(21) Appl. No.: 11/947,816

(22) Filed: Nov. 30, 2007

(65) Prior Publication Data

US 2009/0139987 A1 Jun. 4, 2009

(51) Int. Cl.
*H05B 6/10* (2006.01)
*H05B 6/06* (2006.01)

(52) U.S. Cl.
USPC ..... 219/628; 219/650; 220/581

(58) Field of Classification Search
USPC ..... 219/628, 650, 660; 220/581–592, 220/592.01–592.06
See application file for complete search history.

(56) References Cited

U.S. PATENT DOCUMENTS

| | | | | |
|---|---|---|---|---|
| 2,718,583 | A * | 9/1955 | Noland et al. | 392/458 |
| 4,870,239 | A * | 9/1989 | Rackind | 219/635 |
| 5,990,465 | A * | 11/1999 | Nakaoka et al. | 219/629 |
| 6,436,562 | B1 | 8/2002 | DuBose | |
| 6,548,199 | B1 | 4/2003 | Tanaka | |
| 6,555,801 | B1 * | 4/2003 | LeMieux et al. | 219/656 |
| 6,675,573 | B2 | 1/2004 | Kempfer | |
| 6,692,852 | B2 | 2/2004 | Yang | |
| 6,865,901 | B2 | 3/2005 | Horn | |
| 6,967,315 | B2 * | 11/2005 | Centanni et al. | 219/628 |
| 2002/0027027 | A1 | 3/2002 | Skala | |
| 2002/0098396 | A1 | 7/2002 | Kobayashi | |
| 2002/0168556 | A1 | 11/2002 | Leboe | |
| 2003/0000945 | A1 * | 1/2003 | Pilavdzic et al. | 219/628 |
| 2003/0235734 | A1 | 12/2003 | Halltiner, Jr. | |
| 2004/0055798 | A1 | 3/2004 | Almkermann | |
| 2004/0058215 | A1 | 3/2004 | Bruck | |
| 2004/0081872 | A1 | 4/2004 | Herman | |
| 2004/0137295 | A1 | 7/2004 | Houlberg | |
| 2004/0149759 | A1 * | 8/2004 | Moser et al. | 220/581 |

(Continued)

FOREIGN PATENT DOCUMENTS

| | | |
|---|---|---|
| DE | 3530806 | 1/1987 |
| DE | 10242804 | 4/2004 |

(Continued)

OTHER PUBLICATIONS

English Abstract of JP63026498A, Feb. 4, 1988.

(Continued)

*Primary Examiner* — Jianying Atkisson
(74) *Attorney, Agent, or Firm* — Porter Wright Morris & Arthur LLP

(57) ABSTRACT

A warming system for a fiber composite high pressure gas storage tank for maintaining the temperature of the gas within the tank and the gas flow system associated with one or more boss at the tank ends above the lower design tolerance temperature limit, wherein an induction coil wound around a longitudinal axis of the tank is powered by an on board source of alternating current and a control system regulates the flow of current to the coil to warm a ferromagnetically active component associated with the tank such that the temperature of the tank and the gas flow system of the tank does not drop below the lower tolerance temperature limit of the tank and the gas flow system.

7 Claims, 9 Drawing Sheets

(56) References Cited

U.S. PATENT DOCUMENTS

| | | | |
|---|---|---|---|
| 2004/0151959 | A1 | 8/2004 | Formanski |
| 2004/0209135 | A1 | 10/2004 | Wexel |
| 2005/0095477 | A1 | 5/2005 | Perry |
| 2005/0103479 | A1 | 5/2005 | Richardson |
| 2005/0132720 | A1 | 6/2005 | Rameau et al. |
| 2005/0175870 | A1 | 8/2005 | Hagan et al. |
| 2005/0191534 | A1 | 9/2005 | Kim |
| 2006/0219298 | A1 | 10/2006 | Suzuki |
| 2007/0204631 | A1 | 9/2007 | Udischas et al. |

FOREIGN PATENT DOCUMENTS

| | | | |
|---|---|---|---|
| FR | 1379049 | | 11/1964 |
| FR | 2780102 | | 12/1999 |
| JP | 63026498 | A | 2/1988 |
| WO | 2007072470 | A1 | 6/2007 |

OTHER PUBLICATIONS

English Machine Translation of FR1379049, Oct. 9, 1963.
English Abstract of DE3530806, Jan. 29, 1987.

* cited by examiner 35
34
11
$T_1$
30
ON BOARD ELECTRIC POWER SOURCE
ALTERNATING CURRENT CONVERSION
26
25
$T_4$
TEMPERATURE POWER CONTROL SYSTEM
200
$T_3$
24
14
14b
12
14a
$T_2$
Control Temperature: $T_1$, $T_2$ > Lower Tolerance Limit
$T_1$ = Boss Temperature
$T_2$ = Gas Temperature
$T_3$ = Ambient Temperature
$T_4$ = Surface Proximity Temperature

INDUCTION WARMING SYSTEM FOR FIBER COMPOSITE GAS STORAGE CYLINDERS

FIELD OF THE INVENTION

The present invention relates to an induction heating system for high pressure storage tanks for hydrogen and CNG gas fuel, or other gas, by compensating for thermal and mechanical stresses caused by a low temperature resulting from (1) gas decompression in the tank during driving as the gas is depleted from the tank and (2) environmental exposure of the tanks in low temperature climate conditions. An electrical induction heating system warms the gas tank itself. In the invention, the metal liner in the tank or the polymer fiber composite layer forming the tank shell has an electromagnetic property; and the tank, and the gas therein, can be heated by an induction heating coil wound around the tank diameter. As a result, the heating reduces the risk of a fuel gas leak in cold climate driving conditions and tank durability is increased because the internal temperature changes between the stored gas and the tank, and the related seals and gas flow devices associated with the tank, that otherwise would cause mechanical stresses are minimized. The invention heats the gas stored within the tank and ameliorates mechanical stresses to the tank and the component parts of the tank caused by mechanical stresses associated with the thermal conditions of the tank environment and thermal changes in tank components associated with cooling as the high pressure gas is depleted from the tanks.

BACKGROUND OF THE INVENTION

Vehicles powered by compressed natural gas (CNGV) and hydrogen gas (FCV) typically include on board high pressure gas fuel tanks that may include gas absorbing materials within the tank interior. During driving, the gas inside the tanks becomes cold, caused by the tank pressure decreasing when gas is consumed by the vehicle power plant resulting in decompression of the tank. Gas absorbing materials used in the tank interior will usually absorbs the intrinsic heat in the gas during the gas discharge from the tank during vehicle operation. In cold climates, the internal gas temperature in the tank can drop to −60° C. or below, a temperature that may be below the permissible operating temperature of 0-rings, or other rubber seals, or gas flow controls in the tank. An excessively low temperature in the tank may upset design tolerance limits for the seals and flow controls and result in mechanical discrepancies that cause the stored gas to leak. For example, if the ambient temperature is −20° C., the reduction of internal tank temperature by an additional −40° C. will result in an internal gas temperature of −60° C. Expansion and contraction of the tank and the component parts of the gas flow system associated with the tank caused by temperature fluctuations may produce adverse mechanical stress effects. In the specification herein, reference to hydrogen fuel cell vehicles correlates with the use of the invention with CNGV's (compressed natural gas powered vehicles) and FCV's (hydrogen powered fuel cell or internal combustion engine vehicles). Although hydrogen is typically referred to in the specification and examples, the term "hydrogen" is in most instances intended to be interchangeable with CNG and other fuel gases. The fuel gases are referred to as a "gas" or "high pressure gas."

OBJECTS OF THE INVENTION

It is an object of the present invention to provide a warming system for a carbon fiber composite tank utilizing electromagnetic characteristics of the tank and/or the tank liner to warm the tank and the gas therein. It is a further object to reduce the risk of a fuel gas leak in cold climate driving conditions caused by excessively low tank and/or gas temperatures. As a result, tank durability is increased because the internal temperature difference between the stored gas in the tank and the tank wall is reduced and the other components of the tank system are warmed. The lower extent of temperature fluctuations of a driving cycle in the tank is reduced. The object of the warming system of the present invention is achieved by an electrical induction heating coil wound around the tank diameter whereby electrical current passing through the coil warms the electromagnetically conductive elements of the tank wall and/or the tank liner.

The invention is described more fully in the following description of the preferred embodiment considered in view of the drawings in which:

DETAILED DESCRIPTION OF THE INVENTION

Figure 1:
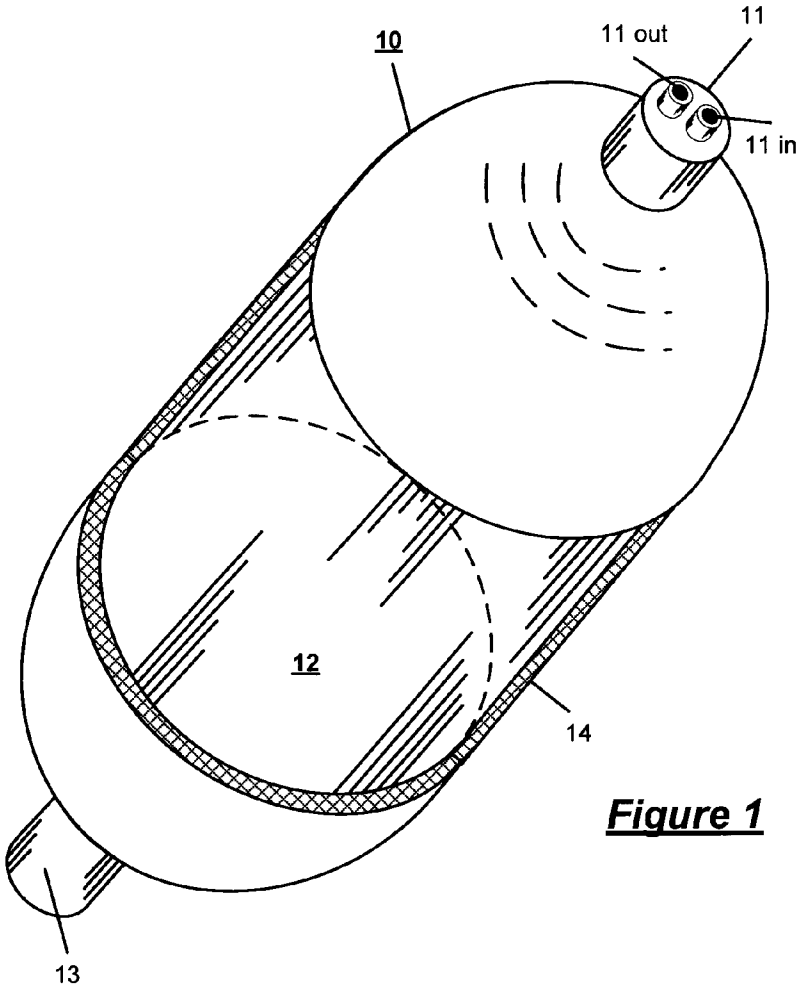
FIG. 1 is a cut away view showing a typical cylindrical high pressure gas storage tank formed from a composite material wherein a fiber or fiber mixture, such as carbon, is impregnated within an epoxy or other resin binder. The tank shown includes a metal boss at each end and an inlet and outlet gas flow components embedded within the boss at one end, and an interior volume.

High pressure gas fueled vehicles including vehicles powered by compressed natural gas (CNGV's), fuel cells (FCV's), and hydrogen gas powered internal combustion engines, in certain instances, include fiber composite gas fuel tanks that include gas absorbing materials in the interior of the tank. During driving, the gas within the tanks becomes cold, caused by a decrease in the tank pressure. When a vehicle tank includes gas absorbing materials, the gas absorbing materials absorb heat during the gas discharge from the tank. Environmentally, a typical ambient temperature is approximately 20° C. In cold climates, the internal gas temperature in a vehicle tank can drop to under −60° C., a temperature that may be below the permissible operating temperature range of O-ring and/or other rubber or polymer seals used in the tank and the port inlet and outlet metal part assemblies that control the inflow and outflow of gas to and from the storage tank. Below the acceptable range of temperature variances allowable for seals, valves, control devices, and the like, thermally caused mechanical variations in the tank and associated assemblies may result in leakage of the stored gas. The invention provides a solution that can efficiently warm the storage tank utilizing the electromagnetic characteristics of the tank materials and an induction coil heater.

In examples, conventionally designed tanks can be used with the invention without any substantial change because of the inherent electromagnetic characteristics of the materials from which the tank and/or liner are formed. Higher heating efficiency is achieved in comparison with an external heater because the tank is heated directly. The power source for the induction system is electrically isolated from the tank. During driving, the gas inside the tank becomes cold as a result of a decrease in tank pressure as the gas is depleted to provide fuel for the vehicle. The condition is worsened when the tank has gas absorbing materials that also absorb heat during the condition of gas discharge. In cold climates, the internal gas temperature can drop to under −60° C., a temperature that may be below the permissible operating temperature of 0-ring or other rubber seals and metallic valve gas flow and regulator devices embedded in a tank boss. Because temperature fluctuations below the tolerance limit may cause mechanical stress in the tank system and consequent leaks of the stored gas heating in accordance with the invention increases the tank system durability by reducing internal temperature changes and reduces the risk of a fuel gas leak in cold climate driving conditions.

High pressure tanks are typically cylindrical with semi spherically shaped domed ends and are formed from a carbon composite shell, a mixture of resin and strands of carbon fiber materials that may be electrically conductive and/or electromagnetically active. Tanks typically include an outer shell and an interior liner.

The invention includes a tank wall lining formed from one or more metal selected from the group of iron, stainless steel, titanium, magnesium, tin, nickel, zinc, chromium (Fe, SUS, Nichrome®, (a brand name for a non-magnetic alloy of nickel and chromium) or an alloy of the foregoing, and similar inductively active materials or compositions. In examples, a tank lining formed from the inductively active materials or compositions partially surrounds the tank interior volume. In instances where it is expected that the bottom of the tank interior will have a lower temperature, additional inductively active materials or compositions are included in the tank structure at the tank bottom to provide additional heat to the bottom area to achieve a more uniform temperature.

Thus, where the typical high pressure gas tank for motor vehicles is formed from a carbon fiber composite shell (carbon fiber resin polymer, "CFRP") and an internal liner usually formed from aluminum or plastic, the invention allows minor variations in tank composition to achieve tank heating; a minor change in tank formulation materials is required to obtain induction heating characteristics wherein heat from the induction heater results from eddy currents generated in the material. Preferred characteristics of tank components include the electrical and electromagnetic characteristics of the tank and shell wherein one or both of the shell and the liner require only an electrical resistance. As examples, a plastic liner will have a non-conductive resistance in the range of over 10^6 ohm*m. In contrast, an aluminum liner will have a resistance of about 2.65×10^−8 ohm*m. The carbon fiber resin polymer shell will have a resistance of 1-2×10^−5 ohm*m. AC current frequency to the induction coil in the invention will be in the range of 20 Hz to 50 kHz.

To adapt the tank to the induction heating system of the invention, the preferred composite materials and their characteristics are that a) the shell is made electrically non-conductive; b) the shell is made ferromagnetically active; and/or c) the liner is made ferromagnetically active. In this regard, for the liner, aluminum is too low in electrical resistance to be heated up. Plastic is too high. in electrical resistance to be heated up.

As described above, in one example, a standard CFRP shell is a useful material in the invention without any change when used with inductively active components. The CFRP shell composition may be modified, however, to achieve induction heating characteristics by the addition in the fabrication process of a fiber, such as a steel wool strand, or a powder (iron) which has ferromagnetic or conductive properties.

Figure 2:
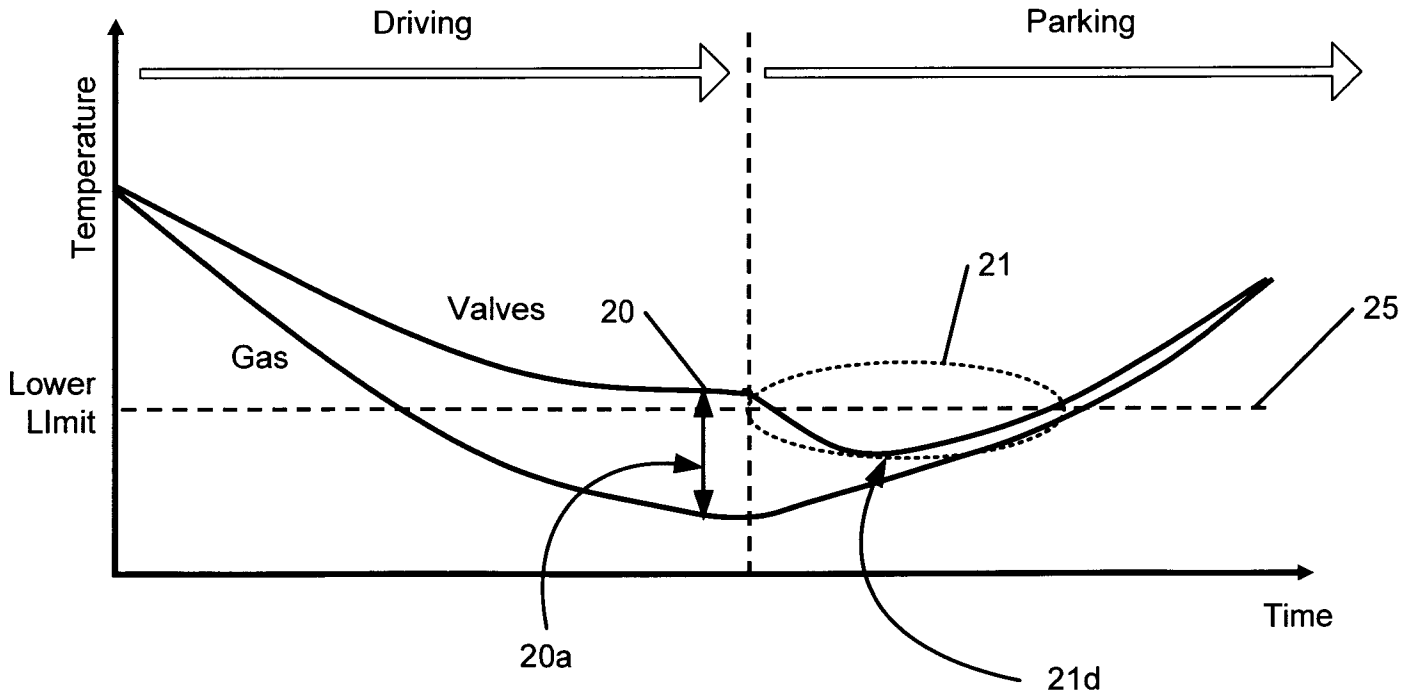
FIG. 2 is a chart of gas and valve temperatures of the tank plotted against a time axis depicting relative temperatures of the gas within the tank and the metal boss elements during the vehicle conditions of driving and parking. The cooling of the metal components is shown wherein valve temperatures are below the lower tolerance limit after a period of driving.

FIG. 1 shows a typical high pressure gas storage tank 10 having an interior volume 12 for the storage of gas with sidewall 14, including a first boss 11 and second boss 13 at either end. A gas inlet 11in and gas outlet 11out. are shown at boss 11. Driving and parking temperature conditions in the vehicle tank system are charted in FIG. 2. During driving, the gas temperature may exceed the lower tolerance limit 25 as gas is depleted and temperature cools. The system of the invention warms the gas above lower limit 25, if necessary. In a typical parking condition, FIG. 2 illustrates that with time, the temperature 20 of the valve system cools to a difference 20*a* below the lower acceptable temperature tolerance limit. In the period shortly after parking 21, the valve temperature 20 cools to a difference 21*d* below the lower acceptable limit 25 of temperature tolerance limit for the valves. Heating in accordance with the invention prevents a temperature drop in the system below the lower tolerance limit.

Figures 3A, 3B:
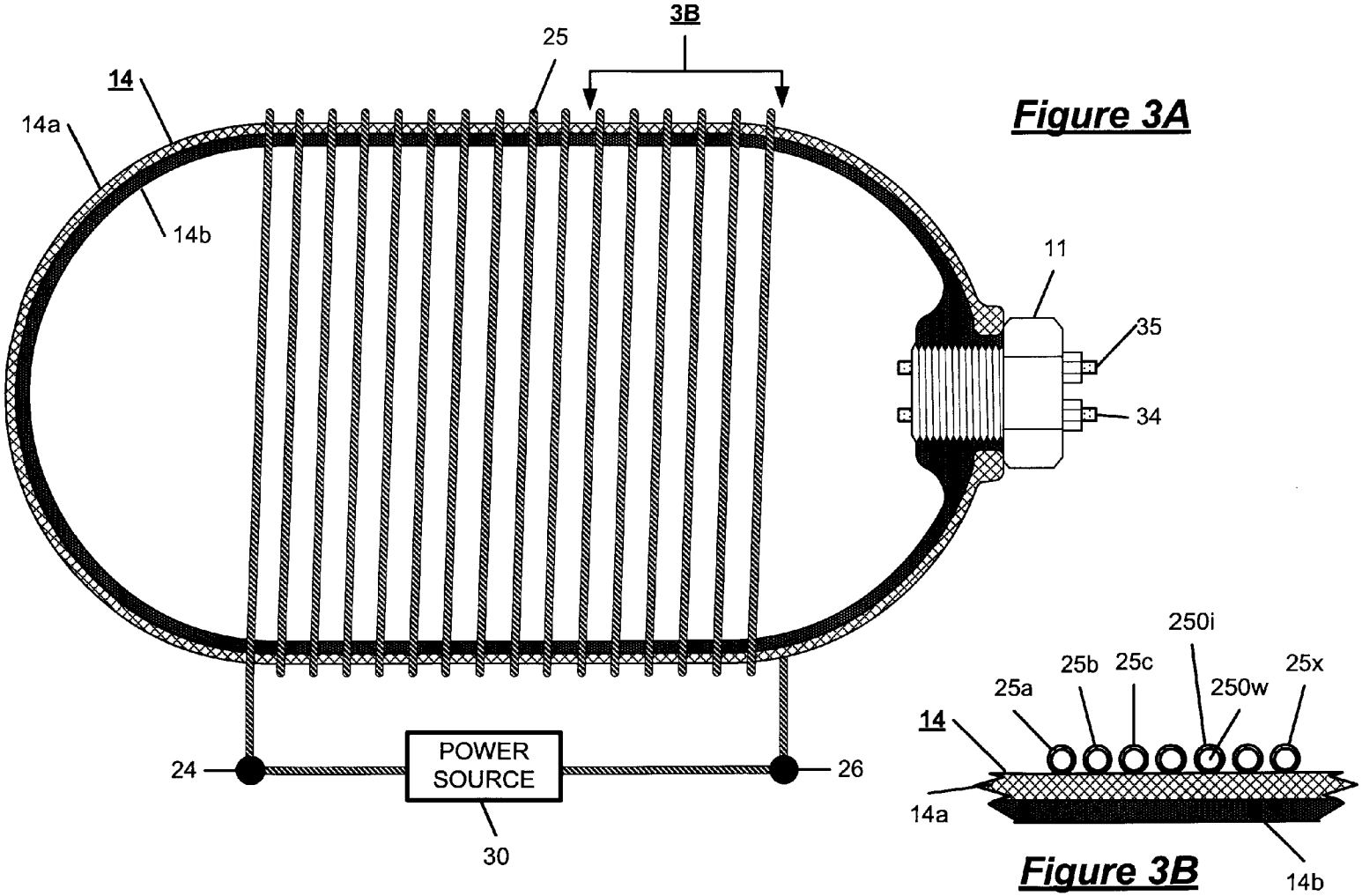
FIG. 3A is a side view of a tank and warming system of the invention wherein an induction coil wound around the external diameter of the tank is interconnected with an electric power source to provide heating for the gas and tank.
FIG. 3B is a cross section of the upper side of the tank wall in FIG. 3A indicated as 3B → ← 3B.

FIG. 3A and FIG. 3B show an example of the invention wherein induction heating warms either the composite shell 14*a* or the metal liner 14*b*, or both of the fiber composite gas tank 14. In FIG. 3A component parts of an example of a complete tank system are shown: tank 14, composite shell 14*a* and liner 14*b*, interior volume for gas storage 14, boss 11 and gas flow conduits, external inlet 34 for gas refueling and external outlet conduit 35 for depletion of gas during driving. The gas flow conduits embedded in the metal boss may also have embedded therein (not shown) one or more of check valves, a pressure regulator and control valves in each of conduits 34 and 35 for regulating gas pressure and direction of flow. Induction coil 25 is wound around the external diameter of the tank and connected through terminals 24 and 26 to an electrical power source 30 on the vehicle providing a flow of current to the induction coil for warming the tank components 14*a* or 14*b*, depending on their electromagnetic characteristics when subjected to the electromagnetic field created by the activated induction coil 25. FIG. 3B is a detail of a section of tank wall, 3B in FIG. 3A, showing the individual electrically conductive wire strands 25*a*, 25*b*, 25*c*, 25*x*, . . . , formed from an electrically conductive core wire 250*w* insulated by sheath 250*i*, wound around the tank.

Figure 4A:
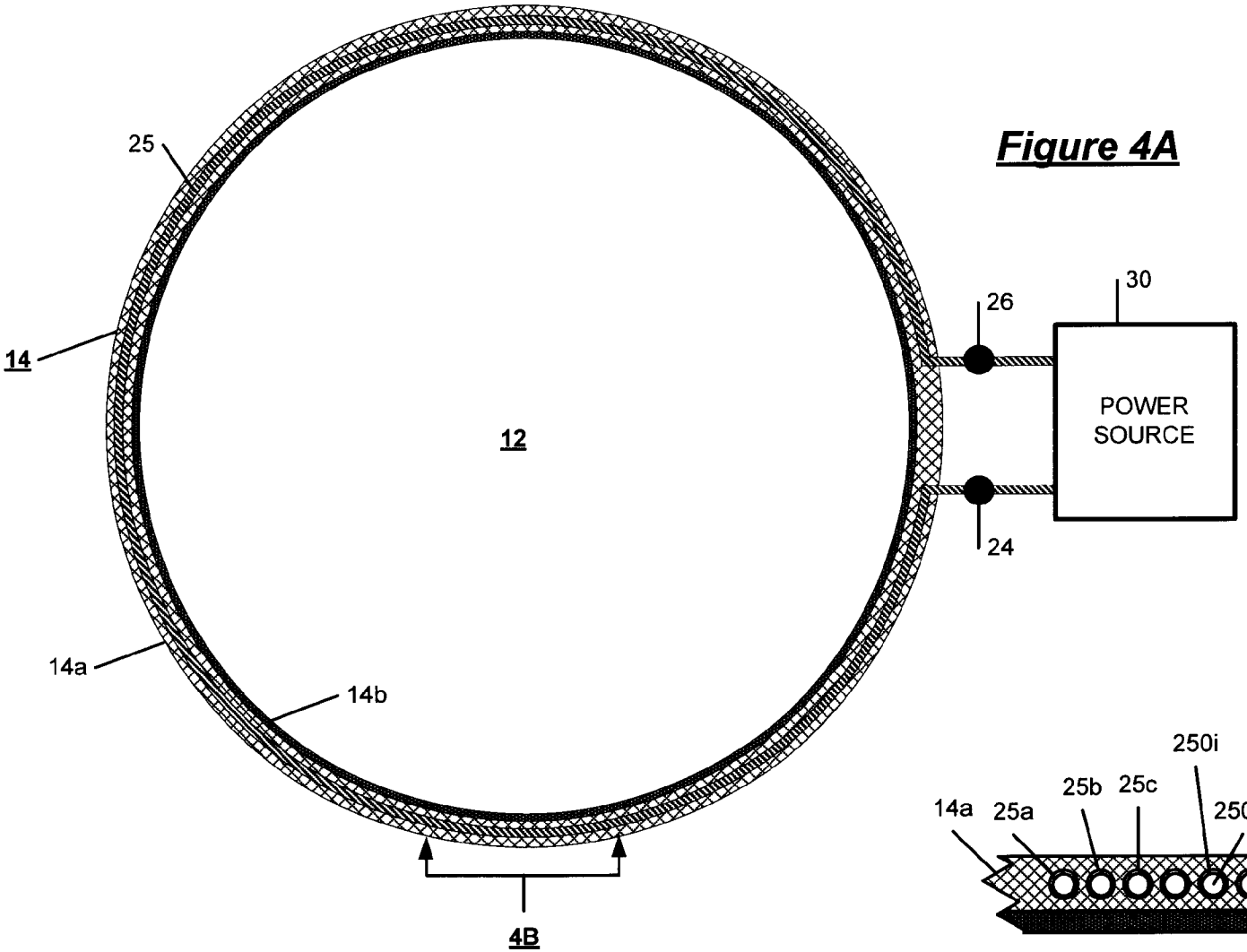
FIG. 4A is a cross section view of an example of a warming system of the invention wherein the induction coil is embedded within the tank wall.
Figure 4B:
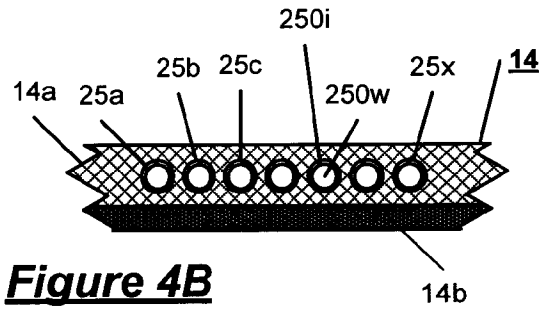
FIG. 4B is a cross section of the longitudinally extending side of the tank wall in FIG. 4A indicated as 4B → ← 4B.

FIG. 4A is a side view of a warming system of the invention wherein the induction coil 25 is embedded within the fiber composite layer of the tank wall interconnected with an on board electrical power source 30 through terminals 24 and 26. FIG. 4B is a cross section of the longitudinally extending side of the tank wall in FIG. 4A indicated as 4B → ← 4B. The induction current warms the tank components, shell 14*a* or liner 14*b*, depending on their electromagnetic characteristics, when subjected to the electromagnetic field created by the activated induction coil 25.

Figure 5A:
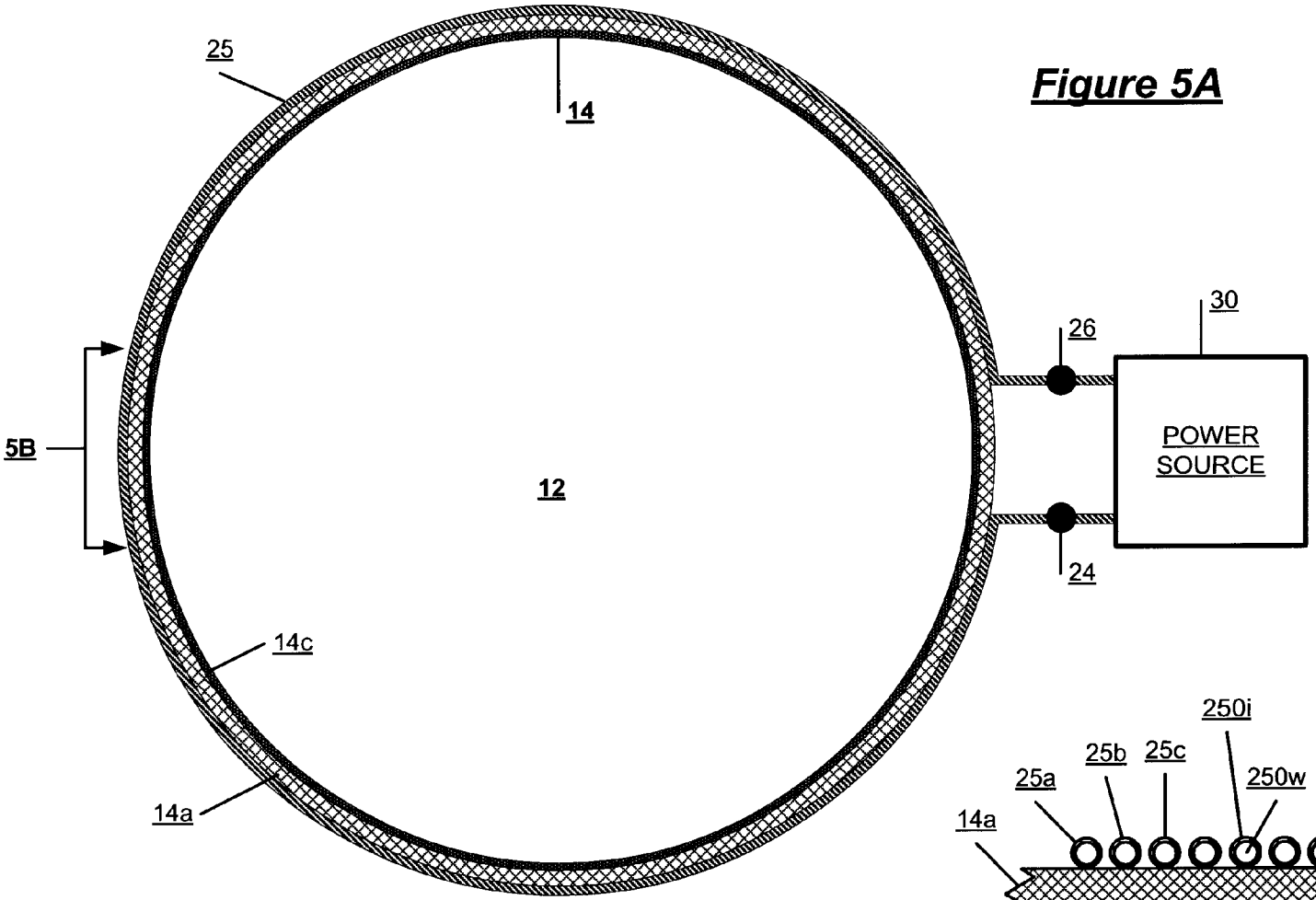
FIG. 5A is a cross section view of an example of a warming system of the invention wherein the induction coil is wound around the external diameter of a tank that includes a metal liner.
Figure 5B:
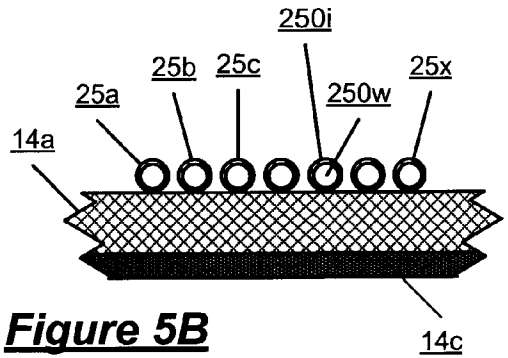
FIG. 5B is a cross section of a longitudinally extending side of the tank wall in FIG. 5A indicated as 5B → ← 5B showing the induction coil, fiber tank shell and metal liner.

FIG. 5A is a cross section view of an example of a warming system of the invention wherein the induction coil 25 is wound around the external diameter of a tank that includes a non conductive, both electrically and electromagnetically, outer composite shell 14*a* and an electromagnetically active ferrous metal liner 14*c*. FIG. 5B is a cross section of a side of the tank wall in FIG. 5A indicated as 5B → ← 5B showing the induction coil, fiber tank shell and metal liner. The detail of FIG. 5B depicts a section of tank wall, 5B in FIG. 5A, showing the individual electrically conductive, insulated wire strands 25*a*, 25*b*, 25*c*, 25*k*, . . . wound around the tank outer shell.

Figure 6:
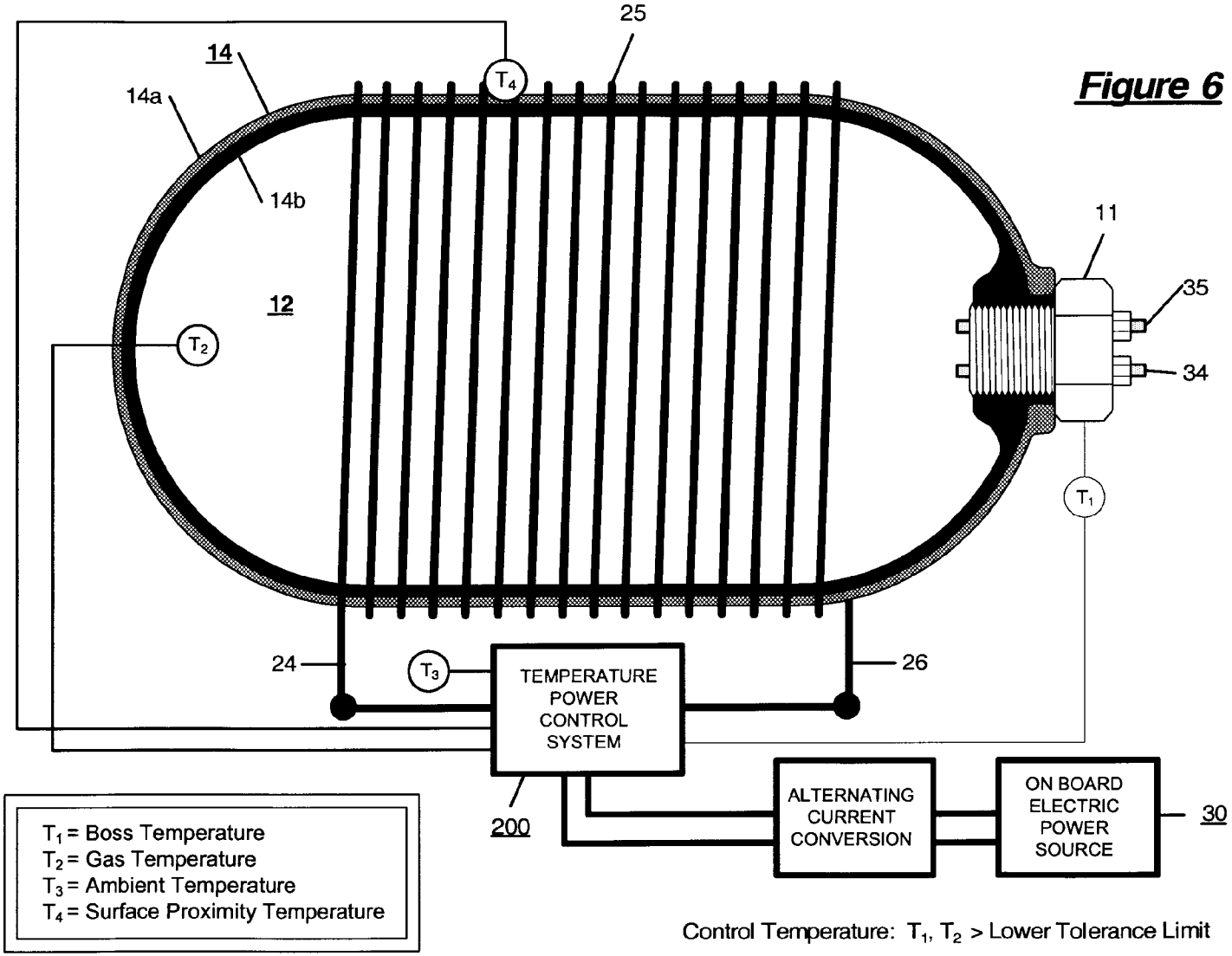
FIG. 6 illustrates a temperature control system utilized in the invention showing the heating system of FIG. 3 as an example.

FIG. 6 illustrates a temperature control system utilized in the invention showing the heating system of FIG. 3 as an example. The heating system of FIG. 3 is shown as an example wherein temperature sensors $T_1$, boss, $T_2$, gas, $T_3$, ambient, and $T_4$, surface coil, provide temperature measurement input into the control system 200, respectively for valve temperature $T_1$, boss 13, gas temperature in the tank volume 12, ambient temperature $T_2$, and tank surface proximity temperature $T_4$. Temperature control system 200 maintains the flow of electric power from the on board source 30 to the wired coil electrodes 24 and 25 that generate the heating effect. Power is regulated such that "Control Temperature: $T_1$, $T_2$>Lower Tolerance Limit [of the tank and valve system]". With reference to FIG. 2 showing tank and valve system temperatures in various operating modes for the vehicle, the control system 200 will heat the system such that the temperature differential shown as 21*a* and 21*d* in FIG. 2 is eliminated and the lower tolerance limit of the system is not exceeded.

Thus, induction heat warms the gas tank itself and an internal induction coil can work as well or better. Because the metal liner or carbon layer has an electromagnetic characteristic, each can be heated up by the Induction heating coil. Conventional tanks can be used without significant change in design, provided that the electromagnetic characteristics are consistent with the teachings of the examples set out above. Higher heating efficiency than an external heater is achieved because the tank itself is heated directly. The on board electrical power source system for providing an alternating current to the induction coil is electrically isolated from the tank. Thus in the invention, induction current flow heats the electromagnetically active (or ferromagnetic) elements of the tank in which eddy currents are generated within the tank materials and the intrinsic resistance or conductivity of the tank or liner, or both, leads to Joule heating. The coil around the tank produces an electromagnetic field when a high-frequency alternating current (AC) is passed through the coil from the board power source. Preferably, the on board power source comprises an AC power supply that produces a high frequency of low voltage and high current. Useful frequencies include alternating currents in the range of 20 Hz to 50 kHz. The number of turns of the induction coil influences the efficiency and field pattern of the warming effect desired.

Figure 7:
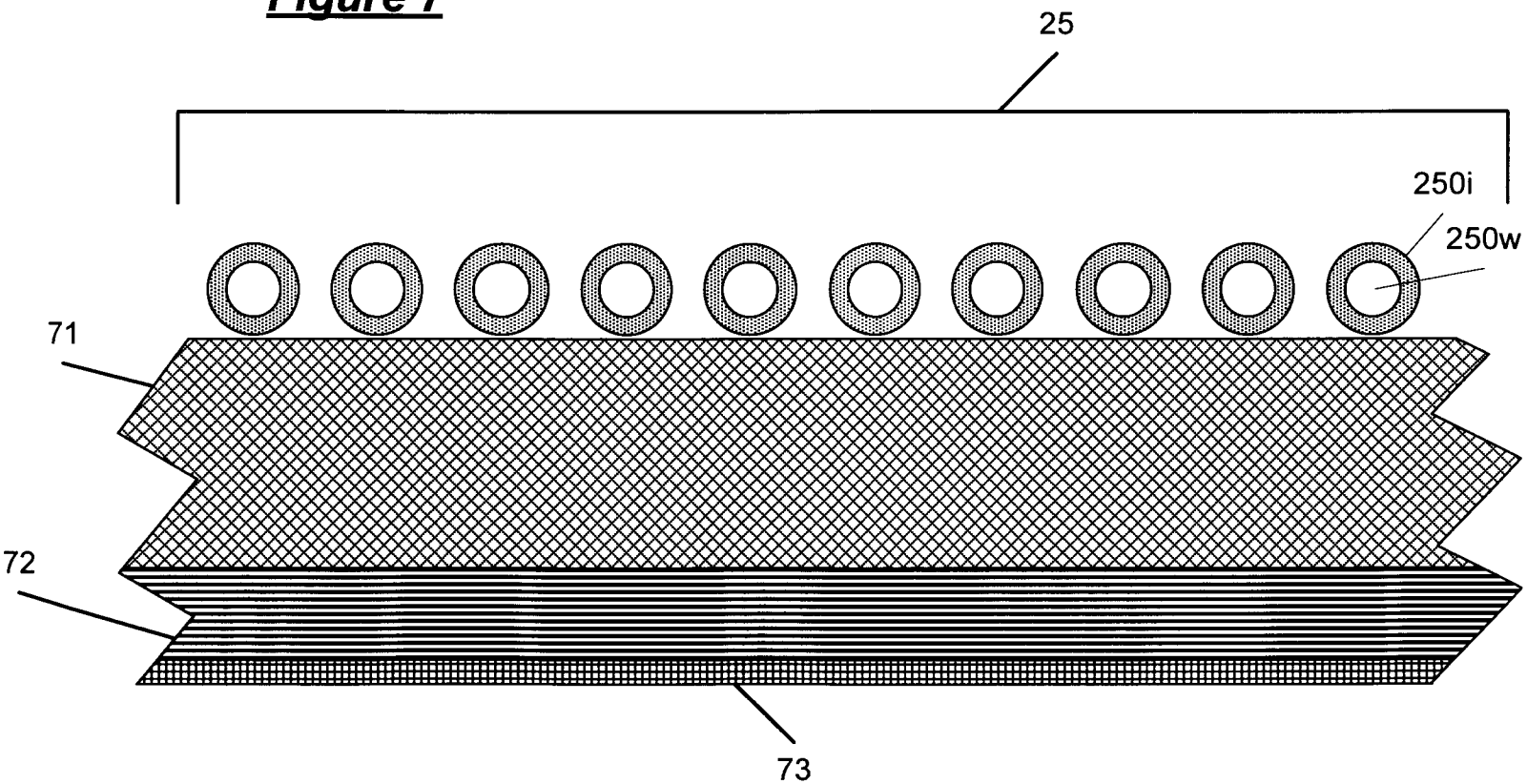
FIG. 7 shows a cross section of an alternately formed tank wall composition useful in the invention.
Figure 8:
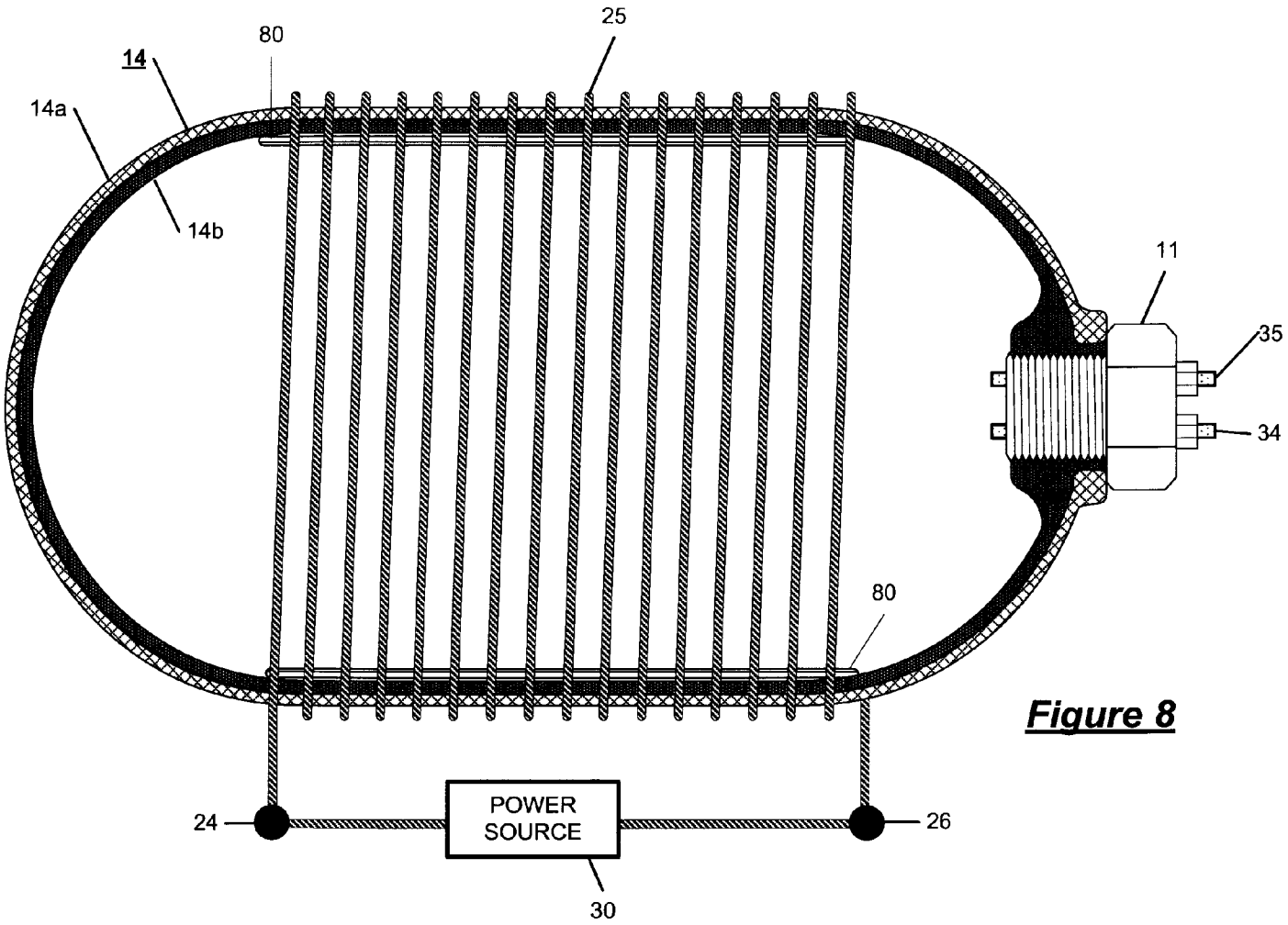
FIG. 8 depicts a tank structure of FIG. 7 including a lining formed from inductively active materials or compositions that partially surrounds the tank interior volume.
Figure 9:
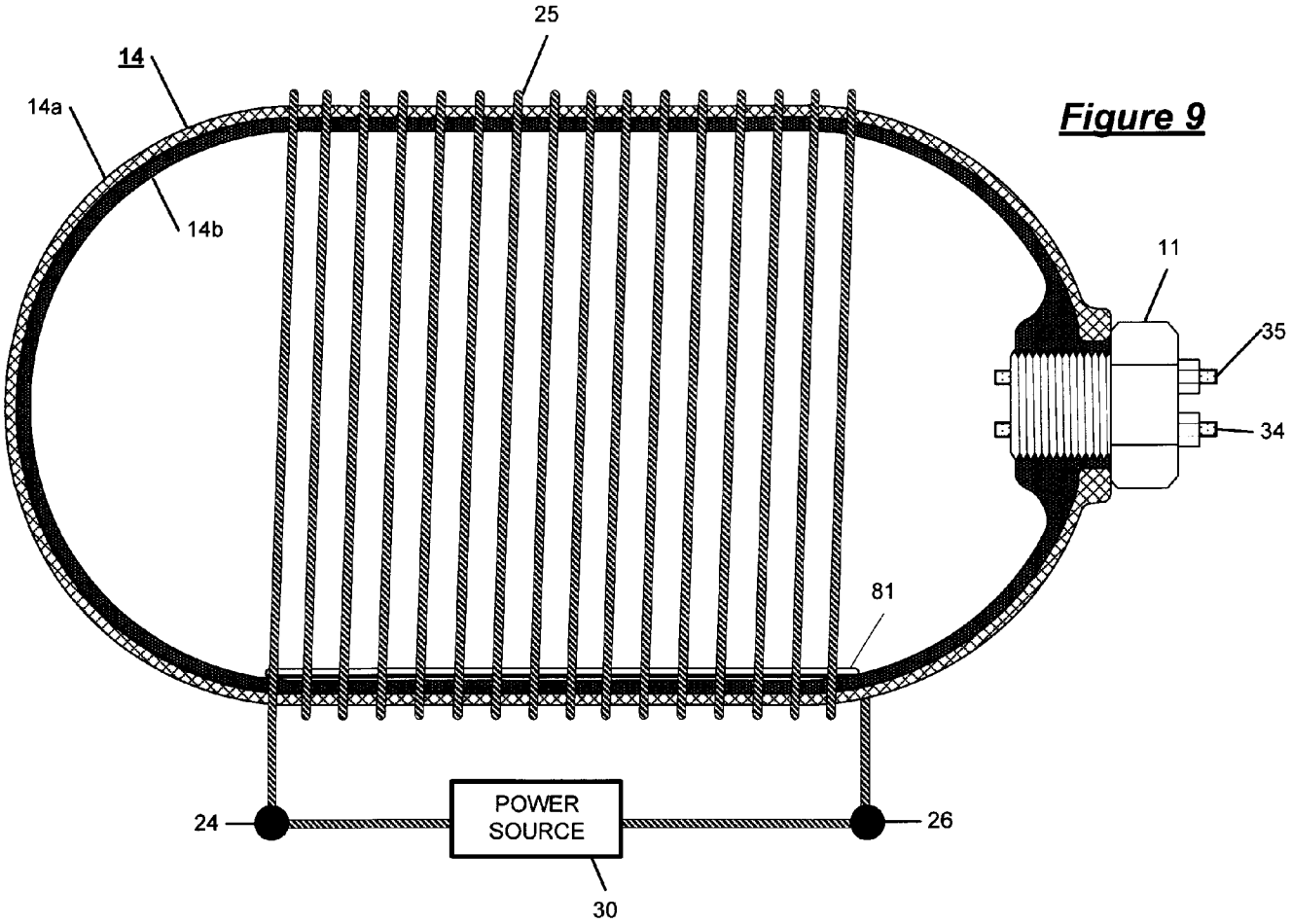
FIG. 9 shows additional inductively active materials or compositions included in the tank structure at the tank bottom to provide additional heat to the bottom area and achieve a more uniform temperature.

In FIG. 7, a cross section of an alternately formed tank wall composition useful in the invention is shown wherein conventional CFRP shell 71 and plastic liner 72 form a tank structure surrounded by induction coil 25 and a sheet, foil, mesh or fiber 73 interior lining is provided as an inductively active heating element. In the application of the induction current, a lower frequency electromagnetic field can penetrate through the tank wall; the field strength is partly diminished by absorption in the CFRP. The remaining induction energy can work inside of the tank heating interior lining 73. The lining to be heated in the tank is preferably formed from Fe, SUS, Nichrome®, Ti, Mn, Sn, Ni, Zn, Cr, an alloy of the foregoing, and similar inductively active materials or compositions. FIG. 8 depicts a tank structure of FIG. 7 wherein the lining 80 to be heated in the tank 14, formed from the inductively active materials or compositions partially surrounds the tank interior volume. It is expected that the bottom of the tank interior will usually have a lower temperature. In FIG. 9, additional inductively active materials or compositions are included in the tank structure at the tank bottom, e.g., 81, to provide additional heat to the bottom area to achieve a more uniform temperature.

Thus, where the typical high pressure gas tank for motor vehicles is formed from a carbon fiber composite shell (carbon fiber resin polymer, "CFRP") and an internal liner usually formed from aluminum or plastic, the invention allows minor variations in tank composition to achieve tank heating. Where, in the typical tank, there is no ferromagnetic material in the tank, a minor change in tank formulation materials is required to obtain induction heating characteristics wherein heat from the induction heater results from eddy currents generated in the material. Preferred characteristics of tank components include the electrical and electromagnetic characteristics of the tank and shell wherein one or both of the shell and the liner require only an electrical resistance. As examples, a plastic liner will have a non-conductive resistance in the range of over 10^6 ohm*m; in contrast, an aluminum liner will have a resistance of about 2.65×10^−8 ohm*m. The carbon fiber resin polymer shell will have a resistance of 1-2×10^−5 ohm*m. AC current frequency to the induction coil in the invention will be in the range of 20 Hz to 50 kHz. To adapt the tank to the induction heating system of the invention, the preferred composite materials and their characteristics are that a) the shell is made electrically non-conductive; b) the shell is made ferromagnetically active; and/or c) the liner is made ferromagnetically active. In this regard, for the liner, aluminum is too low in electrical resistance to be heated up. Plastic is too high. in electrical resistance to be heated up. As described above, in one example, a standard CFRP shell is a useful material in the invention without any change when used with inductively active components. The CFRP shell composition may be modified, however, to achieve induction heating characteristics by the addition in the fabrication process of a fiber, such as a steel wool strand, or a powder (iron) which has ferromagnetic or conductive properties. Preferred powder materials used in forming the tank wall include a filler that is usually a powder composition characterized by an average particle size diameter ranging from about approximately 0.1×10^−6 m to about approximately 500×10^−6 m.

Having described the invention in detail, those skilled in the art will appreciate that, given the present description, modifications may be made to the invention without departing from the spirit of the inventive concept herein described. Therefore, it is not intended that the scope of the invention be limited to the specific and preferred embodiments illustrated and described. Rather, it is intended that the scope of the invention be determined by the appended claims.

The invention claimed is:

1. A warming system for directly heating an onboard high pressure gas storage tank for a vehicle, comprising:

a vehicle mounted storage tank system adapted to contain a consumable high pressure fuel for a vehicle, the storage tank system including a storage tank and inlet and outlet flow assemblies, at least a portion of the storage tank being formed of ferromagnetic active material;

an induction coil at least partially circumscribing at least a portion of said portion of the storage tank formed of ferromagnetic active material;

a power source for supplying an alternating electrical current to the induction coil and creating an alternating electromagnetic field about the storage tank, said ferromagnetic active material in the storage tank being responsive to the alternating electromagnetic field to generate heat; and a temperature control system, the temperature control system including sensors for detecting a temperature of the storage tank system and a temperature of fuel within the tank, the temperature control system being operative to measure and control the temperature differential between the fuel storage system and fuel contained therein and maintain the detected temperature of the storage tank system above a predetermined lower temperature limit by varying said electrical current supplied to the induction coil in response to temperatures detected by the sensors.

2. A warming system as recited in claim 1 wherein the ferromagnetic material of the storage tank includes a shell formed of a polymer fiber composite material with ferromagnetic properties.

3. A warming system as recited in claim 1 wherein the ferromagnetic material of the storage tank includes a liner with ferromagnetic properties.

4. A warming system as recited in claim 3 wherein the liner is formed from one or more metals from the group of iron, stainless steel, titanium, magnesium, tin, nickel, zinc, chromium, aluminum and an alloy of the foregoing.

5. A warming system as recited in claim 1 wherein the temperature control system includes at least one additional temperature sensor for detecting at least one of a flow control component temperature, and an ambient temperature.

6. A warming system as recited in claim 1 wherein the temperature control system further includes temperature sensors for detecting a flow control component temperature, and an ambient temperature.

7. A warming system as recited in claim 1 wherein the induction coil is completely external of the storage tank.

* * * * *